US008069683B2

(12) United States Patent
Lifson

(10) Patent No.: US 8,069,683 B2
(45) Date of Patent: Dec. 6, 2011

(54) REFRIGERANT SYSTEM UNLOADING BY-PASS INTO EVAPORATOR INLET

(75) Inventor: Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 634 days.

(21) Appl. No.: 12/159,026

(22) PCT Filed: Jan. 27, 2006

(86) PCT No.: PCT/US2006/003211

§ 371 (c)(1),
(2), (4) Date: Jun. 24, 2008

(87) PCT Pub. No.: WO2007/086871

PCT Pub. Date: Aug. 2, 2007

(65) Prior Publication Data

US 2008/0314055 A1 Dec. 25, 2008

(51) Int. Cl.
*F25B 49/00* (2006.01)
*F25B 1/10* (2006.01)

(52) U.S. Cl. ..... 62/196.3; 62/225; 62/510

(58) Field of Classification Search ..... 62/196.1, 62/196.3, 197, 225, 510; 417/486; 418/55.1
See application file for complete search history.

(56) References Cited

U.S. PATENT DOCUMENTS 5,996,364 A 12/1999 Lifson et al.
6,058,729 A 5/2000 Lifson et al.
6,138,467 A 10/2000 Lifson et al.
6,385,981 B1 5/2002 Vaisman
6,428,284 B1 8/2002 Vaisman
6,571,576 B1 6/2003 Lifson et al.
6,748,754 B2 * 6/2004 Matsumoto et al. ..... 62/175
6,883,341 B1 4/2005 Lifson

FOREIGN PATENT DOCUMENTS

WO WO2005047783 5/2005

OTHER PUBLICATIONS

Search Report PCT/US06/03211.
International Preliminary Report on Patentability dated Aug. 7, 2008.

* cited by examiner

*Primary Examiner* — Marc Norman
(74) *Attorney, Agent, or Firm* — Carlson, Gaskey & Olds, PC

(57) ABSTRACT

A refrigerant system has at least one unloader valve selectively communicating refrigerant between the compressor compression chambers and a point upstream of the evaporator. When the compressor is run in unloaded mode, partially compressed refrigerant is returned to a point upstream of the evaporator. In an unloaded mode, a higher refrigerant mass flow rate passes through the evaporator, as compared to prior art where the by-passed refrigerant was returned downstream of the evaporator. This increases system efficiency by more effectively returning oil which otherwise might be left in the evaporator back to the compressor. Also, the amount of refrigerant superheat entering the compressor in unloaded operation is reduced as compared to the prior art compressor systems, wherein the by-passed refrigerant is returned directly to the compressor suction line. Reduced refrigerant superheat increases system efficiency, improves motor performance and reduces compressor discharge temperature. Also, by moving the unloader line further away from the compressor, the compressor replacement is simplified as there is no connecting unloader line directly in front of the compressor.

15 Claims, 3 Drawing Sheets

REFRIGERANT SYSTEM UNLOADING BY-PASS INTO EVAPORATOR INLET

BACKGROUND OF THE INVENTION

This invention relates to a unique placement for the connection between an unloader line valve and a lower pressure refrigerant line.

One of the compressor types that are especially suited for this invention is a scroll compressor. Scroll compressors are becoming widely utilized in compression applications. However, scroll compressors present several design challenges. One particular design challenge is achieving reduced capacity levels when full capacity operation is not desired.

Thus, scroll compressors, as an example, have been provided with unloader by-pass valves that divert a portion of the compressed refrigerant back to a compressor suction port. In this way, the amount of refrigerant compressed by a compressor is reduced. Of course, other compressor types may also have a by-pass valve for similar purpose, as for example, a screw compressor, where a by-pass valve can by-pass a part of refrigerant from the intermediate compression pocket within the screw compressor back to a suction line.

In a system disclosed in U.S. Pat. No. 5,996,364, a refrigerant system has both a by-pass line and an economizer circuit. The by-pass line communicates the vapor from the economizer line directly to the suction line. This by-pass line is provided with the unloader valve. When it is desired to have unloaded operation, the unloader valve is opened, and the economizer valve is closed. Refrigerant may thus then be returned from an intermediate point in the compression process directly back to suction.

U.S. Pat. No. 6,883,341 discloses an improvement to the above-described system wherein the economizer line communicates back to the main low pressure refrigerant line, not between the evaporator and the compressor, but upstream of the evaporator. Various benefits are achieved by this placement. This is disclosed in U.S. Pat. No. 6,883,341, owned by the assignee of the current application, and invented by the inventor of the current application. However, this application is limited to the situation wherein an economizer cycle is also incorporated into the system. It is also limited to a situation where only a single by-pass valve is present in the system. The present invention is directed to a compressor wherein an unloader line is not associated with an economizer cycle. The present invention also discloses an operation where several unloader lines can be present. In addition to the by-pass line being either fully open or fully closed for a prolonged period of time, the present invention also discloses a by-pass valve that can operate in a pulse width modulation regime: rapidly opening and closing to control the amount of refrigerant by-passed into the location upstream of the evaporator. The percentage of time that the valve is open determines the degree of by-pass modulation being achieved. The cycling rate of the pulse width modulated valve is selected to be shorter than the response time of the system. In this case the system does not respond fast enough to changes in the refrigerant flow through the unloader line, creating a situation where the systems responds as if the valve(s) are partially opened rather than being cycled between their open and closed positions.

While this prior art system has achieved many benefits, there are certain additional refinements that would be beneficial.

SUMMARY OF THE INVENTION

In a disclosed embodiment of this invention, a compressor is provided with at least one by-pass line. An unloader valve is positioned on the by-pass line and is operable to selectively communicate refrigerant from a compression point to a point upstream of the evaporator. This unloader line is attached to a point that is at an intermediate position in the compression process.

The present invention provides several benefits over the prior art that returns refrigerant from an intermediate compression point directly to the suction line. In this invention, the refrigerant from the compression point is returned upstream of the evaporator (preferably at a location between the main expansion valve and the evaporator entrance) instead of being returned downstream of the evaporator (at a location between the evaporator exit and compressor suction port). This results in a greater refrigerant mass flow through the evaporator during unloaded operation over the prior art. Increased refrigerant mass flow improves return flow of oil to the compressor during unloaded operation, increasing the efficiency of the evaporator by improving the heat transfer characteristics of the evaporator. Improved oil return also minimizes a risk of pumping the oil out of the compressor oil sump and storing it in the evaporator. If the oil is pumped out from the compressor, then the compressor could be damaged because bearings and other compressor elements may not receive adequate lubrication for proper operation.

Further, as is known, a sensor is typically provided downstream of the evaporator to control an amount of opening of the main expansion device to maintain a required superheat of the refrigerant leaving the evaporator. By returning the refrigerant from the unloader line upstream of the sensor and evaporator, the temperature of the refrigerant entering the compressor will be lower then temperature of the refrigerant if the refrigerant would have been returned downstream of the evaporator entrance. When the refrigerant is returned downstream of the evaporator, the refrigerant that enters the compressor is hotter because it also carries the refrigerant from the additional hot by-pass stream exiting the intermediate compression point. High refrigerant temperature entering the compressor is undesirable since it can overheat the motor driving the internal compressor elements, cause excessive discharge temperature and result in the lubricating oil degradation or damage to the internal compressor elements due to overheating.

In another feature, the prior art had an unloader by-pass valve just outside the compressor. As such, the valve and associated piping, etc. was often in the way should it become necessary to replace the compressor. By moving the by-pass line and the unloader by-pass valve away from the compressor toward the evaporator inlet, more space surrounding the compressor is created, which simplifies the compressor replacement. In yet another feature of this invention the compressor is provided with more than one unloader line and associated unloader by-pass valves. Each unloader line is connected at different compression points. With this arrangement one unloader line can be connected to return a partially compressed refrigerant upstream of the evaporator while the other unloader line can return a partially compressed refrigerant downstream of the evaporator. In yet another arrangement both unloader lines can be connected such that they both return the refrigerant upstream of the evaporator. Following the above logic even more than two unloader lines can be utilized in the present invention. A solenoid type valve is an example of the type of a by-pass valve for these applications, where the valve plunger is moved to alternate the valve opening between open and closed positions. In addition to the valve type where the by-pass valve is either fully open or fully closed for a prolonged period of time, a described by-pass valve can be selected to be a rapidly cycling valve; where the valve operates by a pulse width modulated control between open and closed position. The percentage of time that the valve is open determines the degree of modulation being achieved and the amount of flow by-passed through the valve. The valve cycling rate is normally selected to be shorter than the response time of the system. With this, the system responds as if the valve(s) is partially opened rather than being cycled between fully open and closed positions.

The present invention thus provides valuable benefits.

These and other features of the present invention can be best understood from the following specification and drawings, the following of which is a brief description.

DETAILED DESCRIPTION OF THE PREFERRED EMBODIMENT

Figure 1:
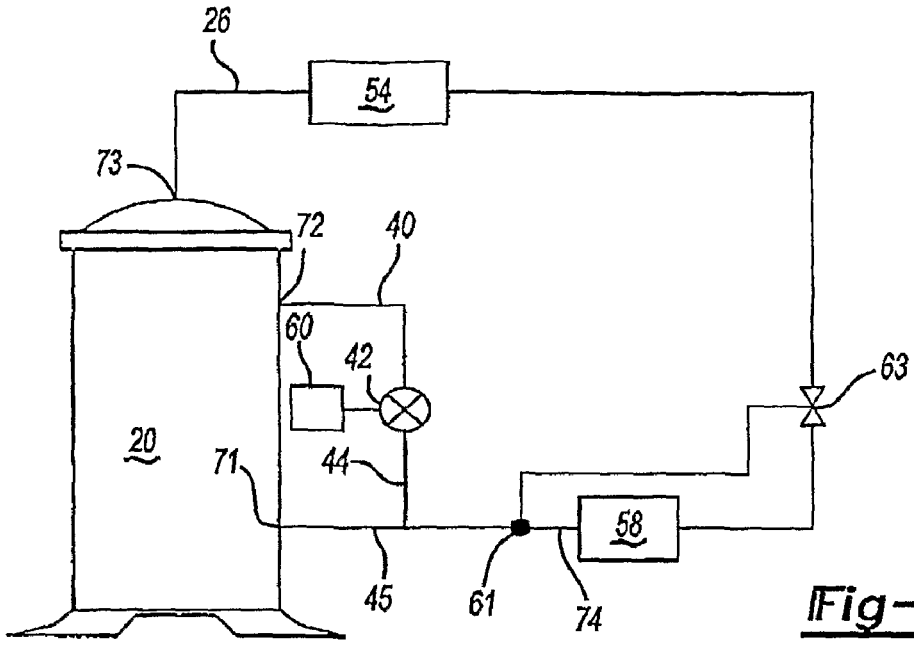
Fig-1 PRIOR ART
FIG. 1 is a schematic view of a prior art refrigerant cycle.

As shown in Prior Art FIG. 1, there is a compressor 20 that has a suction port 71, an intermediate compression port 72 and a discharge port 73. A line 40 establishes a communication between intermediate compression port 72 and suction line 45 through line 44.

As shown, a sensor 61 senses the condition of the refrigerant downstream of the evaporator 58 in line 74 and communicates with a main expansion device 63. It should be noted that a sensor 61 can, for example, be a feeler bulb of thermostatic expansion valve (TXV) or a temperature sensor of electronic expansion valve (EXV). However, regardless of the type of the sensor or expansion device type, the purpose of the sensor is to control the amount of main expansion device opening to achieve a desired amount of expansion of the refrigerant approaching the evaporator 58 such that the refrigerant leaving the evaporator 58 has a desired superheat amount upon entering compressor suction port 71. However, during unloaded operation, by-pass line 44 returns relatively hot refrigerant to the suction line 45 downstream of the sensor 61. The sensor 61 is thus not achieving the desired superheat of the refrigerant returning through suction line 45 to the suction inlet port 71 of the compressor 20 when the compressor is operating in by-pass mode. That is, the sensor 61 would not be aware of the increase in the refrigerant temperature in line 45 due to the returned hot refrigerant from the by-pass line 44 being mixed with refrigerant from line 74, and would thus not achieve the desired superheat of the refrigerant entering the compressor through port 71.

Preferably, the by-pass path 44 and valve 42 are positioned outwardly of the scroll compressor housing, thus simplifying the control arrangements of valve 42 and the assembly of the scroll compressor. However, the by-pass path 44 and valve 42 may be within the housing. The valve 42 is selectively open and closed to control the amount of refrigerant passing through line 44.

Figure 2:
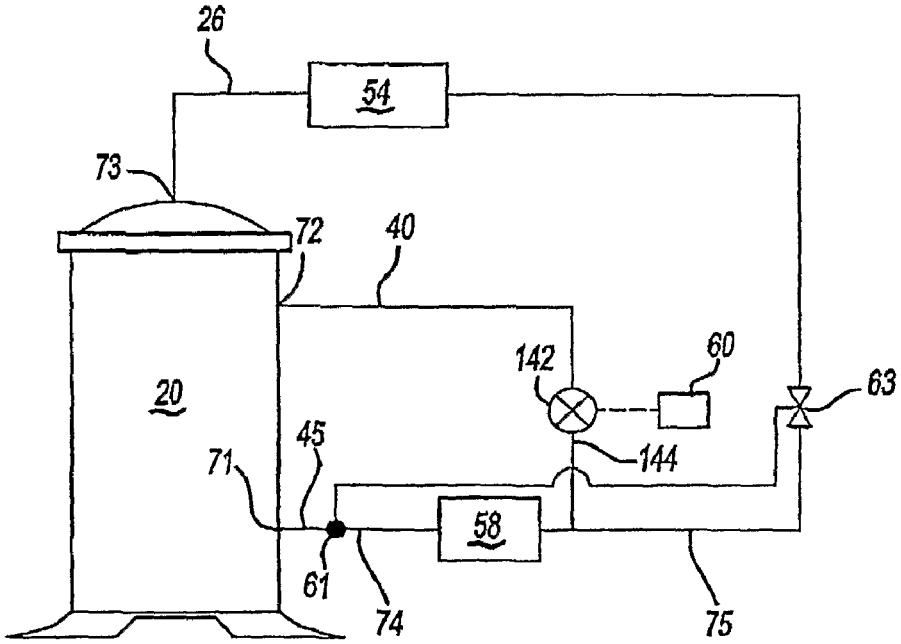
FIG. 2 shows the inventive refrigerant cycle with a single unloader line

FIG. 2 shows the inventive system. Components having the same general configuration and location are labeled by the same number as in FIG. 1. By-pass line 144 and the unloader valve 142 are now positioned such that refrigerant is returned through the by-pass line 144 upstream of the evaporator 58. When the refrigerant is returned through the by-pass line 144 in unloaded mode, this refrigerant will mix with the main refrigerant flow in line 75 traveling to the evaporator 58. The temperature sensor 161 that is still positioned downstream of the evaporator 58, will now sense the combined effect of both the by-passed refrigerant from line 144 and the main refrigerant flow. However, now the sensor will control the amount of refrigerant superheat in the combined stream leaving the evaporator 58 and entering the compressor through suction port 71. Thus, the temperature of the refrigerant entering the compressor through port 71 will be reduced as compared to the prior art arrangement. This temperature reduction improves compressor reliability by reducing the motor winding temperature, prevents compressor lubricating oil breakdown, as well as reducing compressor discharge temperature and potential damage to the internal compressor elements due to overheating.

Further, there is a greater refrigerant mass flow of refrigerant through the evaporator 58 in the unloaded mode of operation than in the prior art system, since an additional amount of refrigerant is added to the main refrigerant stream before it enters the evaporator. The increase in the amount of refrigerant through the evaporator improves the oil return through the suction line 45 to the compressor 20. The improved oil return in turn improves heat transfer capability of the evaporator since less oil remains on the heat transfer surfaces of the evaporator. The improved oil return to the compressor also minimizes a possibility of oil leaving the compressor, thus, preventing potential compressor damage due to lack of lubricating oil.

Further, in the prior art, wherein the by-pass line and by-pass valve were positioned adjacent to the compressor to communicate the by-passed refrigerant to the suction line, compressor replacement was cumbersome. The present invention, by moving the by-pass line and by-pass valve to a location further away from the compressor, simplifies the compressor replacement.

Figure 3:
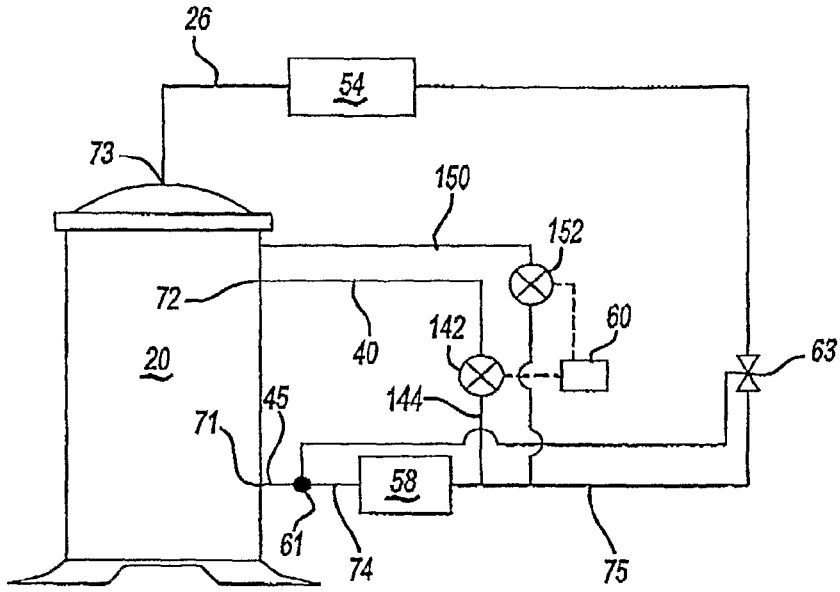
FIG. 3 shows the inventive refrigerant cycle with two unloader lines both returning the refrigerant upstream of evaporator

FIG. 3 shows another embodiment wherein a second unloader line 150 having a separate unloader valve 152 is added into the refrigerant system. As can be seen, the second unloader line 150 communicates back to a refrigerant line 75 upstream of evaporator 58. Please note as a variation on the embodiment, the lines downstream of the valves 142 and 152, instead of each line being connected to line 75, can first be connected to each other downstream of the valves 142 and 152 and then this common connection downstream of these valves can be connected to line 75.

Figure 4:
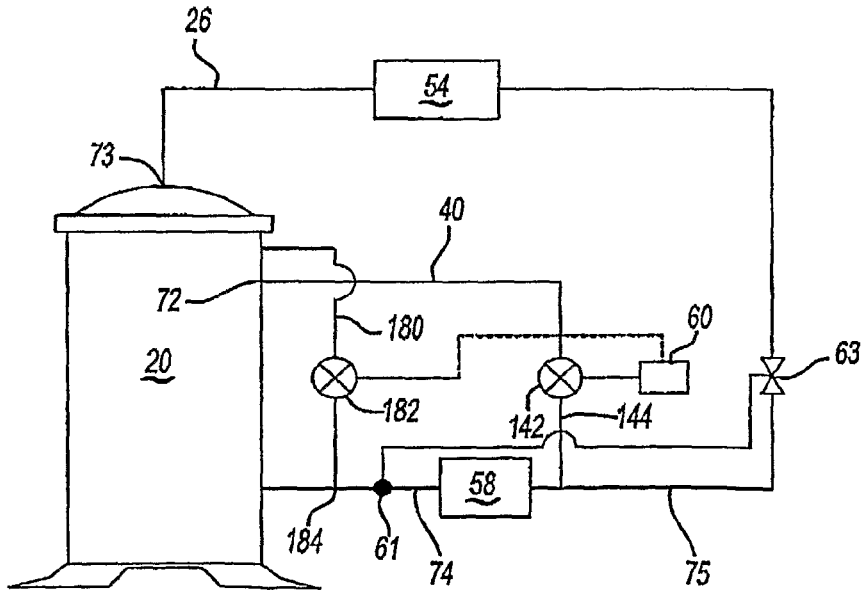
FIG. 4 shows the inventive refrigerant cycle with two unloader lines, where one returns the refrigerant upstream and the other downstream of the evaporator.

FIG. 4 shows another embodiment, providing an example where one of the unloader lines communicates downstream of the evaporator and the other unloader line communicates upstream of the evaporator. In this example, an unloader line 180 and a separate valve 182 communicate with a point 184 downstream of sensor 61. The options shown in FIGS. 3 and 4 allow the compressor designer to achieve variations in the amount of refrigerant unloaded, and also in the amount of refrigerant delivered upstream of the evaporator. The above embodiments also include a controller 60 that can control the operation of by-pass valves 142 and/or valve 152 and/or valve 182. The controller can either keep at least one of these valves open when the by-pass operation is required or keep at least one of these valves closed when there is no need to have a by-pass through at least one of the by-pass lines. If the valves are suited for rapid pulse width modulation, the controller can control the amount of time any of these valves remain open and closed to maintain the desired amount of the by-pass flow through these valves.

Figure 5:
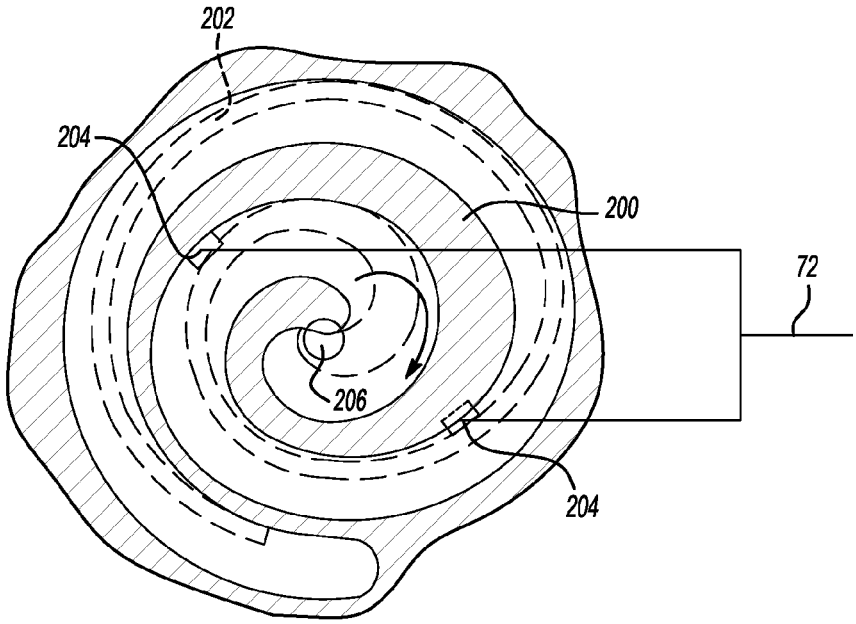
FIG. 5 shows the location of the compressor internal by-pass ports for a single unloader line

FIG. 5 shows internal structure of one embodiment for achieving the single unloader line scroll compressor such as shown for example in FIG. 2. As shown, a fixed scroll member 200 interfits with an orbiting scroll member 202. Internal unloader ports 204 communicate back to the port 72 and then to line 40. An internal discharge port 206 is shown downstream of the internal by-pass ports 204.

Figure 6:
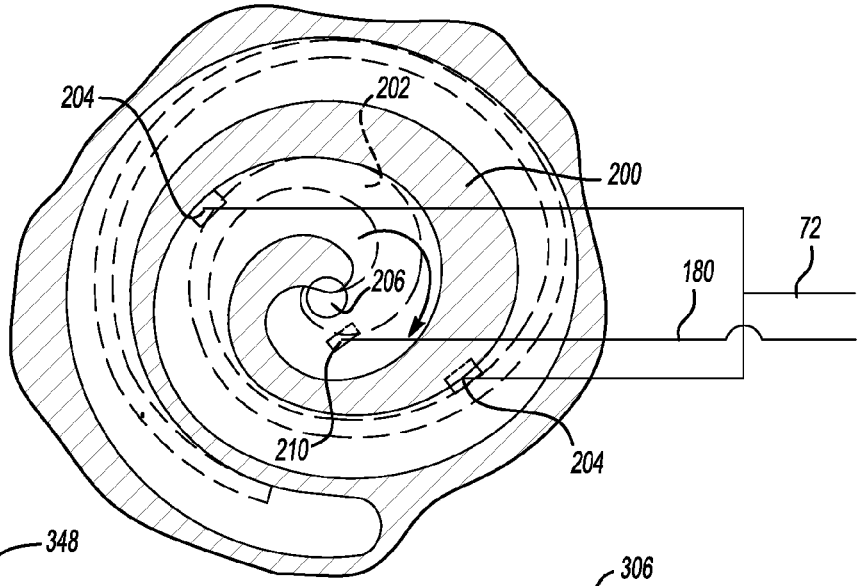
FIG. 6 shows the location of the compressor internal by-pass ports for two unloader lines.

FIG. 6 shows an embodiment which is suited for the FIGS. 3 and 4 embodiments. An additional internal port 210 is positioned downstream of the location of ports 204. The line 180 communicates with port 210.

Figure 7:
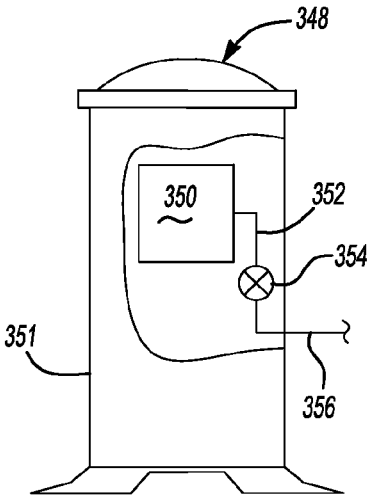
FIG. 7 shows another embodiment.

FIG. 7 shows another embodiment compressor 348 wherein a compressor pump unit 350 is received within a housing 351. The unloader line 352 and its valve 354 are also positioned within the housing. A suction line 356 is shown communicating with the line 352. Of course, this embodiment shows the feature schematically, however, it does make clear that one of the unloader line that by-passes the refrigerant downstream of the evaporator can be internal to the compressor housing 351.

Figure 8:
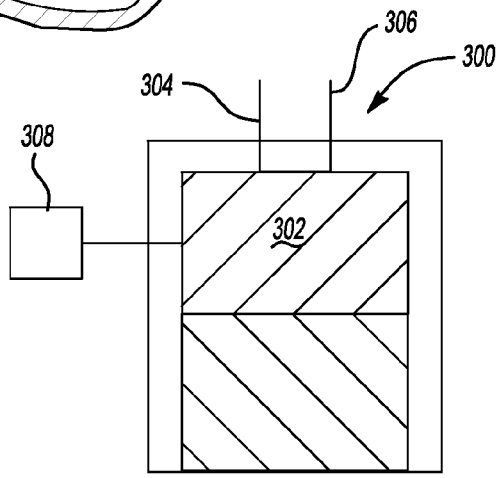
FIG. 8 shows yet another embodiment.

FIG. 8 shows another embodiment 300 schematically. In this embodiment, the compressor pump unit 302 consisting of two rotors is shown as being driven by a motor 308, and the unloader lines 304 and 306 are spaced axially along the length of the compressor pump unit 302. The unloader lines 304 and 306 communicate with the screw compressor pump unit at separate points within the compression process. In this arrangement, the connection of these unloader lines to the rest of the system can be accomplished in a similar fashion as the connection of the lines 40 and 150 or 180 of FIGS. 3 and 4. Of course, instead of having two by-pass lines as shown in FIG. 8, the screw compressor pump unit can have more than two by-pass lines or only one by-pass line. In case of one by-pass the connection of this by-pass line to the rest of the system can be made similar as shown in FIG. 2 for line 40. Of course, other type compressors may also be utilized with this invention.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A refrigerant cycle:

a compressor;

said compressor having an outlet providing a refrigerant to a condenser, said condenser providing refrigerant to a main expansion device, refrigerant moving from said main expansion device to an evaporator, and a compressor suction inlet downstream of said evaporator;

at least one unloader valve for selectively communicating a compressed refrigerant from said compressor from at least one intermediate compression point to a point upstream of said evaporator; and there being two unloader valves communicating a compressed refrigerant from said compressor from two intermediate compression points to at least one point upstream of the said evaporator.

2. The refrigerant cycle as recited in claim 1, wherein said at least one unloader valve is a solenoid valve.

3. The refrigerant cycle as recited in claim 1, wherein said at least one unloader valve is a rapidly cycling valve.

4. The refrigerant cycle as recited in claim 1, wherein said compressor is a scroll compressor.

5. The refrigerant cycle as recited in claim 1, wherein said compressor is a screw compressor.

6. The refrigerant cycle as recited in claim 1, wherein said at least one unloader valve is positioned in a by-pass passage mounted outwardly of a compressor housing.

7. The refrigerant cycle as recited in claim 1, wherein said at least one unloader valve is positioned in a by-pass passage mounted inwardly of a compressor housing.

8. The refrigerant cycle as recited in claim 1, wherein a sensor is positioned downstream of said evaporator, and upstream of said suction inlet to said compressor, said sensor controlling said main expansion device to achieve a desired amount of superheat at an outlet of said evaporator.

9. The refrigerant cycle as recited in claim 1, wherein said one unloader valve communicates refrigerant from an intermediate compression point back to said point upstream of said evaporator.

10. A refrigerant cycle:

a compressor;

said compressor having an outlet providing a refrigerant to a condenser, said condenser providing refrigerant to a main expansion device, refrigerant moving from said main expansion device to an evaporator, and a compressor suction inlet downstream of said evaporator;

at least one unloader valve for selectively communicating a compressed refrigerant from said compressor from at least one intermediate compression point to a point upstream of said evaporator;

there bring two unloader valves communicating a compressed refrigerant from said compressor from two intermediate compression points, where the first unloader valve communicates to a point upstream of the said evaporator and the second unloader valve communicates to a point downstream of the said evaporator.

11. A refrigerant cycle comprising:

a scroll compressor pump unit having compression chambers;

at least one port passing into said compression chambers;

said compressor pump unit having an outlet providing a refrigerant to a condenser, said condenser providing refrigerant to a main expansion device, and said refrigerant moving from said main expansion device to an evaporator, and a suction inlet being provided back to said compressor downstream of said evaporator;

an unloader system selectively communicating a port to a point upstream of said evaporator, said unloader system including a by-pass line to said point upstream of said evaporator and an unloader valve selectively opening said by-pass line, compressed refrigerant from said compression chambers passing through said port and to said point upstream of said evaporator when said unloader valve is open; and there being, two unloader valves communicating a compressed refrigerant from said compressor from two intermediate compression points to at least one point upstream of the said evaporator.

12. A refrigerant cycle as recited in claim 11, wherein a sensor is positioned downstream of said evaporator, and upstream of said suction inlet to said compressor, said sensor controlling said main expansion device to achieve a desired amount of superheat on an outlet of said evaporator.

13. A refrigerant cycle as recited in claim 11, wherein said unloader valve is positioned in a by-pass passage mounted outwardly of a compressor housing.

14. The refrigerant cycle as recited in claim 11, wherein said unloader valve communicates refrigerant from an intermediate compression point back to said point upstream of said evaporator.

15. The refrigerant cycle as recited in claim 11, wherein a first unloader valve communicates to a point upstream of the said evaporator and a second unloader valve communicates to a point downstream of the said evaporator.

* * * * *